US008202129B2

(12) United States Patent
Lin

(10) Patent No.: US 8,202,129 B2
(45) Date of Patent: Jun. 19, 2012

(54) NETWORK CONNECTOR WITH AN ELASTIC TERMINAL SUPPORT RACK

(75) Inventor: Yen-Lin Lin, Luchou (TW)

(73) Assignee: Jyh Eng Technology Co., Ltd., Luchou, Taipei Hsien (TW)

( * ) Notice: Subject to any disclaimer, the term of this patent is extended or adjusted under 35 U.S.C. 154(b) by 115 days.

(21) Appl. No.: 12/907,971

(22) Filed: Oct. 19, 2010

(65) Prior Publication Data

US 2012/0094524 A1 Apr. 19, 2012

(51) Int. Cl.
*H01R 24/00* (2011.01)

(52) U.S. Cl. ..... 439/676

(58) Field of Classification Search ..... 439/676, 439/941, 76.1, 248, 404
See application file for complete search history.

(56) References Cited

U.S. PATENT DOCUMENTS

| | | | | |
|---|---|---|---|---|
| 6,641,443 | B1 | 11/2003 | Itano et al. | |
| 6,786,776 | B2 | 9/2004 | Itano et al. | |
| 7,601,034 | B1 * | 10/2009 | Aekins et al. | 439/676 |
| 7,794,286 | B2 * | 9/2010 | AbuGhazaleh et al. | 439/676 |
| 7,857,667 | B1 * | 12/2010 | Wang | 439/676 |
| 7,985,101 | B2 * | 7/2011 | Fitzpatrick | 439/676 |
| 8,002,590 | B2 * | 8/2011 | Ciezak et al. | 439/676 |
| 8,021,197 | B2 * | 9/2011 | Milette et al. | 439/676 |

* cited by examiner

*Primary Examiner* — Jean F Duverne
(74) *Attorney, Agent, or Firm* — Guice Patents PLLC

(57) ABSTRACT

A network connector includes an elastic terminal support rack mounted in an insulation main body to support 8pcs of metal conducting terminals. The elastic terminal support rack comprises a rectangular open frame, an elongated elastic block transversely suspending in the rectangular open frame, a plurality of arched bars connected between the rear edge of the rectangular open frame and the elongated elastic block and 8 pcs of ribs located on the top side of the elongated elastic block and respectively configured subject to the shapes of the tilting portions of the metal conducting terminals to give sufficient support.

4 Claims, 6 Drawing Sheets

NETWORK CONNECTOR WITH AN ELASTIC TERMINAL SUPPORT RACK

BACKGROUND OF THE INVENTION

1. Field of the Invention

The present invention relates to electrical connector technology and more particularly, to a network connector, which uses an elastic terminal holder block to give sufficient support to the metal conducting terminals against the inserted matting network plug.

2. Description of the Related Art

A network connector is to be installed in a motherboard for the connection of a mating network plug for the transmission of network data signal. A regular commercial network connector is known comprising an insulation main body, 8 pces of metal conducting terminals mounted in the insulation main body, each metal conducting terminal having a tilting portion for the contact of one respective metal conducting terminal of the inserted mating network plug, a circuit board to which the rear end portions of the metal conducting terminals are electrically connected, and an IDC (insulation displacement contact) housing mounted on the rear side of the insulation main body for the passing of a network cable to connect to the circuit board and the metal conducting terminals.

According to the aforesaid design, the tilting portions of the metal conducting terminals are suspending in the insulation main body. After multiple times in plugging and unplugging, the metal conducting terminals may be unable to return to their former shape, causing contact error and data transmission loss and affecting the transmission speed.

To solve the aforesaid problem, many measures have been disclosed, such as U.S. Pat. No. 6,641,443, entitled "Electrical connector jack"; U.S. Pat. No. 6,786,776, entitled "Electrical connector jack". These designs commonly have a base provided at the front side of the circuit board. The base comprises a plurality of hook-shaped spring arms corresponding to the metal conducting terminals. Each hook-shaped spring arm has a head portion for supporting the tilting portion of the corresponding metal conducting terminal.

However, the hook-shaped spring arms are separated members. It takes much time and labor to install the hook-shaped spring arms. Further, the 8 pcs of metal conducting terminals are arranged in four pairs, and the bents of the metal conducting terminals that are respectively extended from the tilting portions are differently configured. However, because the head portions of the hook-shaped spring arms are same in shape, the hook-shaped spring arms cannot give same support to the metal conducting terminals, resulting in a contact problem.

SUMMARY OF THE INVENTION

The present invention has been accomplished under the circumstances in view. It is one object of the present invention to provide a network connector, which uses an elastic terminal support rack to support a bent of each of the 8 pcs of metal conducting terminals thereof against downward sinking upon insertion of a mating external network plug and to enhance the contact force between the metal conducting terminals and the respective metal conducting terminals of the inserted matting network plug.

To achieve this and other objects of the invention, a network connector comprises a insulation main body defining a front insertion hole for the insertion of a matting network plug, an elastic terminal support rack mounted in the insulation main body at the bottom side of the front insertion hole, the elastic terminal support rack comprising a rectangular open frame elastic terminal support rack having opposing front edge and rear edge, an elongated elastic block transversely suspending in the rectangular open frame, a plurality of arched bars connected between the rear edge of the rectangular open frame and the elongated elastic block and 8 pcs of ribs located on a top side of the elongated elastic block and equally spaced in a parallel manner, 8 pcs of metal conducting terminals mounted in the elastic terminal support rack, each metal conducting terminal comprising a front positioning end portion positioned in the elastic terminal support rack, a rear tailpiece, a tilting portion connected between the front positioning end portion and the rear tailpiece for the contact of one corresponding metal conducting terminal of a matting network plug to be inserted into the front insertion hole of the insulation main body and a bend connected between the tilting portion and the tailpiece and supported on one the rib of the elastic terminal support rack, a circuit board perpendicularly attached to the rear edge of the elastic terminal support rack for the insertion and connection of the metal conducting terminals, an insulation displacement contact housing disposed at the back side relative to the circuit board for the passing of a network cable to connect to the circuit board and the metal conducting terminals, and a back cover that comprises a top cover shell and a bottom cover shell respectively pivotally connected to the back side of the insulation main body and adapted for wrapping said insulation displacement contact housing.

Further, the elastic terminal support rack comprises 8 isolation slots downwardly extending from the front edge of the rectangular open frame in a parallel manner for the positioning of the front positioning end portions of the metal conducting terminals respectively Further, the elastic terminal support rack comprises two protruding mounting blocks respectively protruded from two distal ends of the rear edge of the rectangular open frame for positioning in the insulation main body.

DETAILED DESCRIPTION OF THE PREFERRED EMBODIMENT

Figure 1:
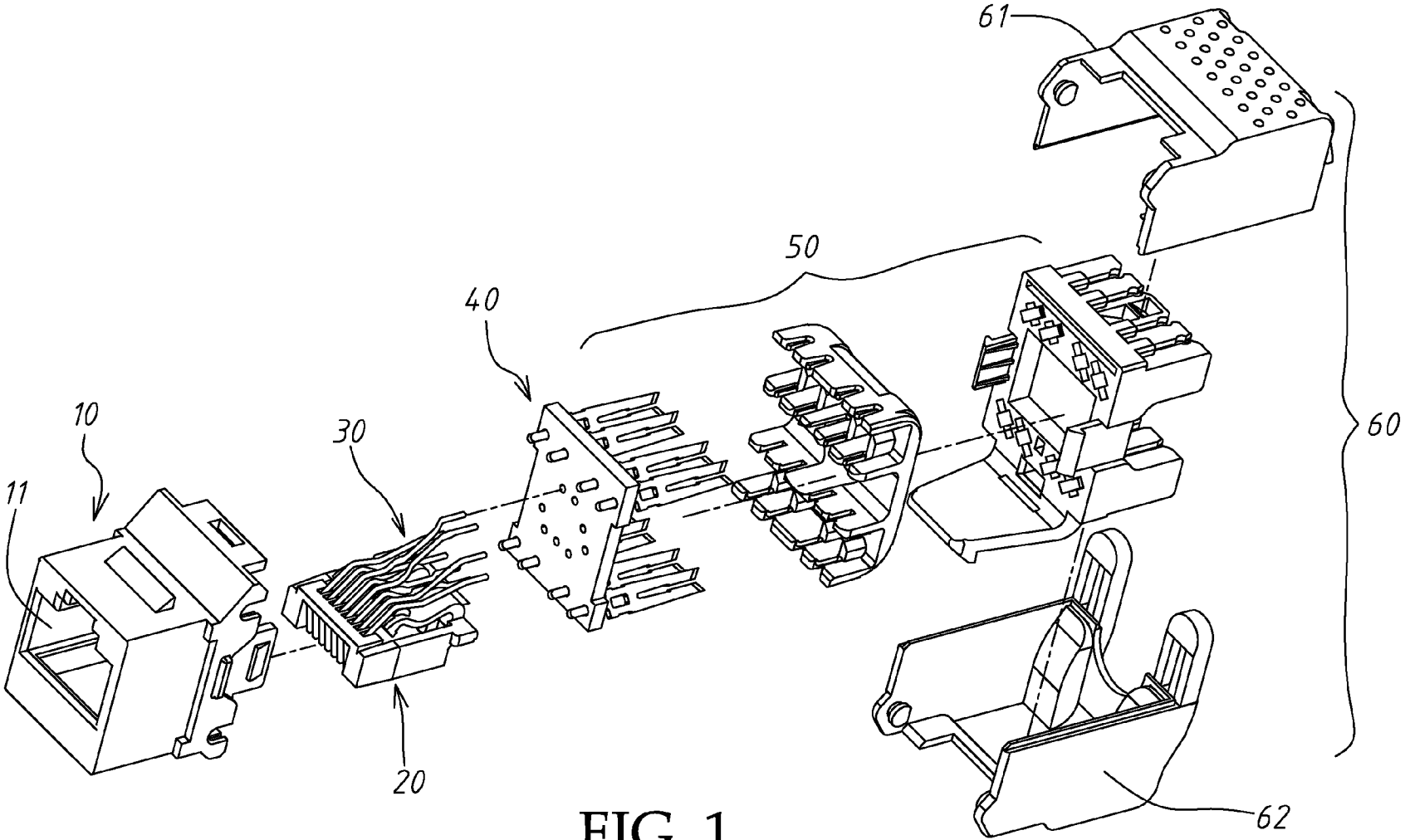
FIG. 1 is an exploded view of a network connector in accordance with the present invention.
Figure 2:
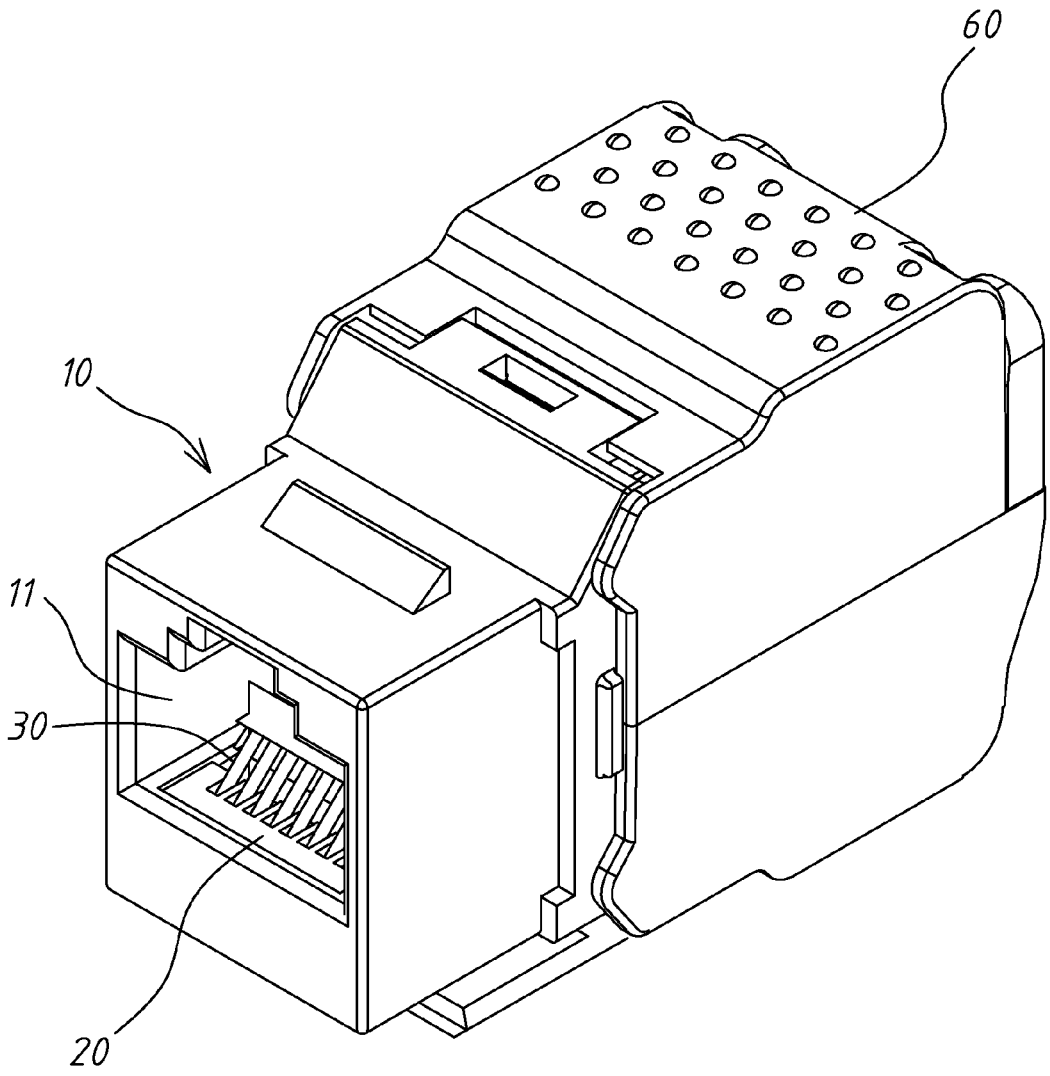
FIG. 2 is an elevational view of the network connector in accordance with the present invention.

Referring to FIGS. 1 and 2, a network connector in accordance with the present invention is shown comprising an insulation main body 10, an elastic terminal support rack 20, 8 pcs of metal conducting terminals 30, a circuit board 40, an IDC (insulation displacement contact) housing 50 and a back cover 60.

The insulation main body 10 defines a front insertion hole 11 for the insertion of a matting network plug (not shown).

Figure 3:
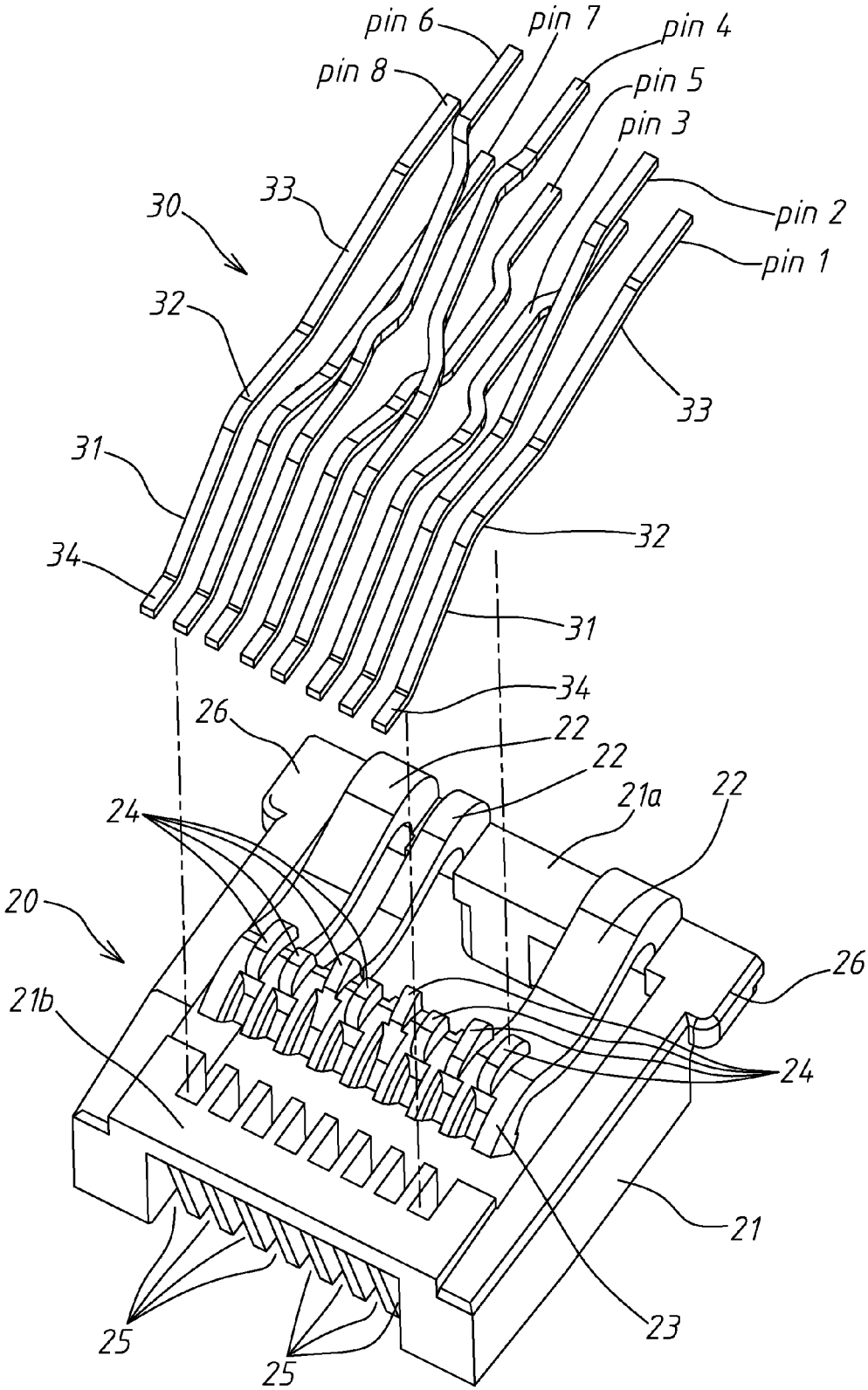
FIG. 3 is an exploded view of a part of the present invention, illustrating the relationship between the elastic terminal holder block and the metal conducting terminals.

The elastic terminal support rack 20 is mounted in the insulation main body 10 at the bottom side of the front insertion hole 11. The metal conducting terminals 30, i.e., pins 1~8 as shown in FIG. 3, are properly mounted in the elastic terminal support rack 20. The circuit board 40 is mounted on the rear side of the elastic terminal support rack 20 at right angles for the insertion of the metal conducting terminals 30. The IDC (insulation displacement contact) housing 50 is disposed at a back side relative to the circuit board 40 for the passing of a network cable (not shown) that is electrically connected to the circuit board 40 and the metal conducting terminals 30. The back cover 60 comprises a top cover shell 61 and a bottom cover shell 62 respectively pivotally connected to the back side of the insulation main body 10 and adapted for wrapping the DC (insulation displacement contact) housing 50 and for allowing the network cable to extend to the outside.

Referring to FIGS. 3-6, the main feature of the design of the present invention is focused on the elastic terminal support rack 20 that gives sufficient support to the metal conducting terminals 30.

The elastic terminal support rack 20 comprises a rectangular open frame 21, an elongated elastic block 23 transversely suspending in the rectangular open frame 21, a plurality, for example, three arched bars 22 (see FIG. 3) connected between the rear edge 21*a* of the rectangular open frame 21 and the elongated elastic block 23, and 8 pcs of ribs 24 of different shapes located on the top side of the elongated elastic block 23 and equally spaced in a parallel manner.

Further, each metal conducting terminal 30 comprises a front positioning end portion 34, a rear tailpiece 33, a tilting portion 31 connected between the front positioning end portion 34 and the rear tailpiece 33 for the contact of one corresponding metal conducting terminal of a matting network plug to be inserted into the front insertion hole 11 of the insulation main body 10, and a bend 32 connected between the tilting portion 31 and the tailpiece 33. The 8 pcs of metal conducting terminals 30 are arranged in four pairs, therefore the bends 32 of the metal conducting terminals 30 are differently shaped. The 8 pcs of ribs 24 of the elastic terminal support rack 20 are configured subject to the shapes of the bends 32 of the metal conducting terminals 30.

Figure 5:
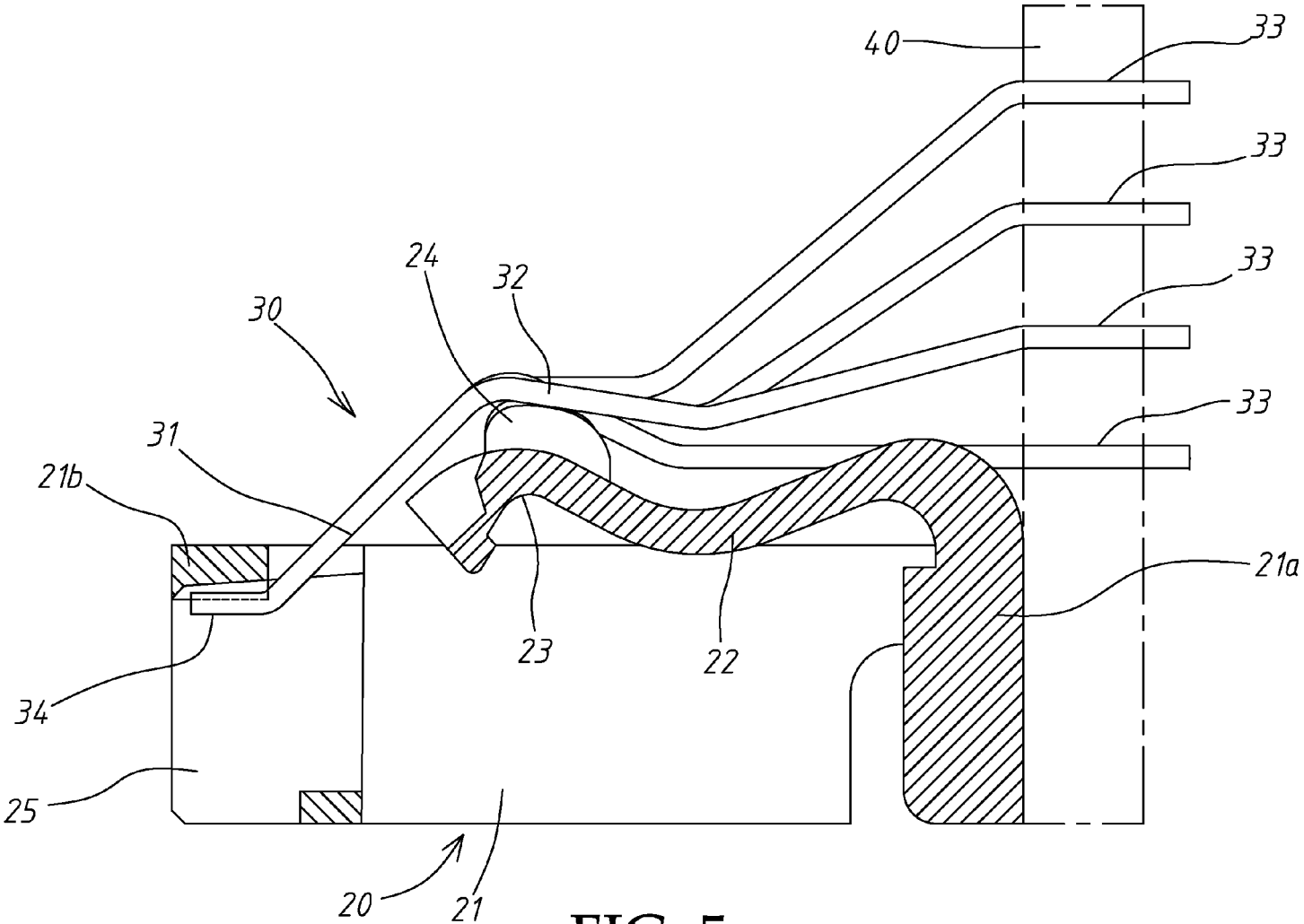
FIG. 5 is a sectional side view, in an enlarged scale, of a part of the present invention, illustrating the metal conducting terminals installed in the elastic terminal holder block and electrically connected to the circuit board.
Figure 6:
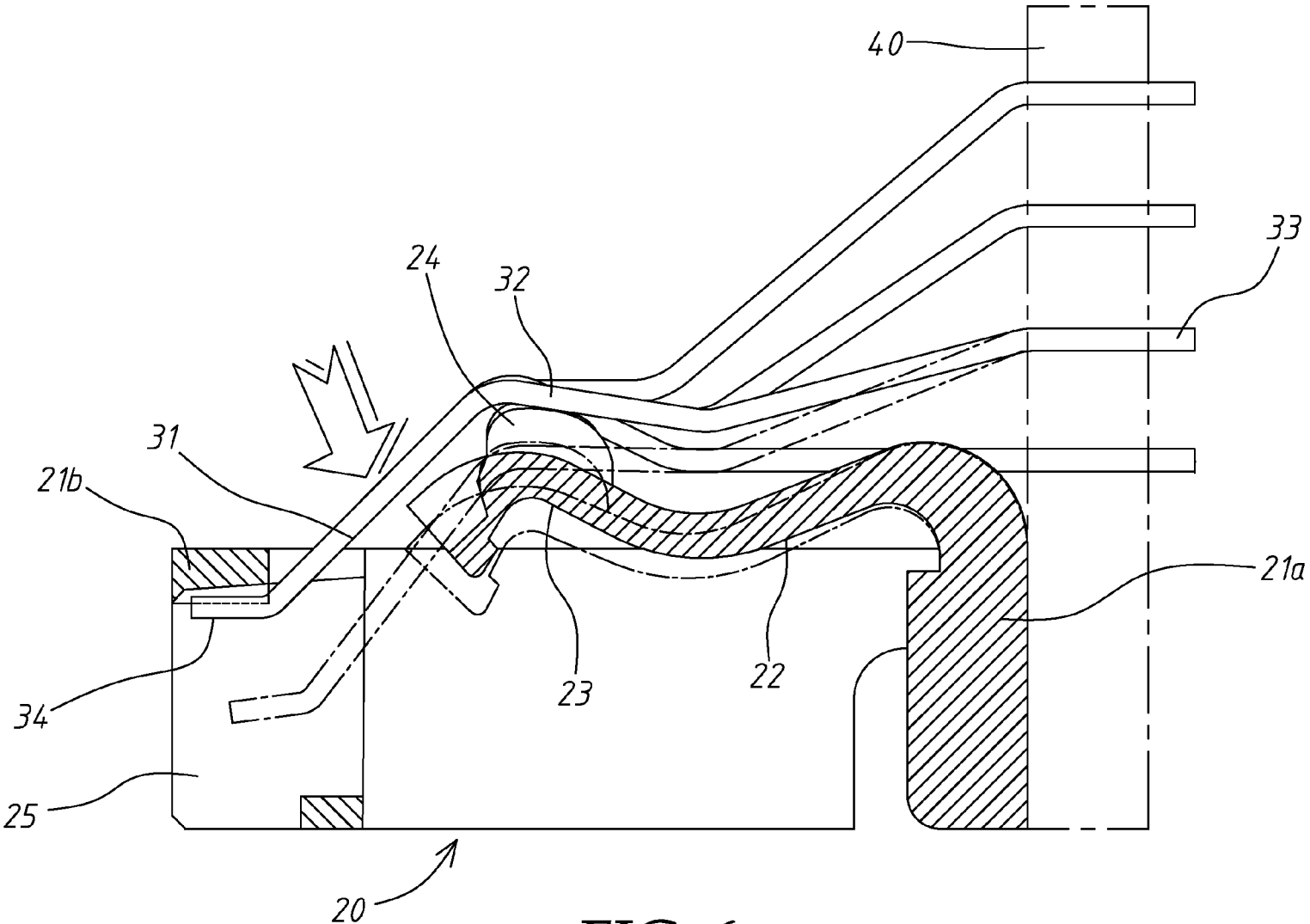
FIG. 6 is a schematic drawing of a part of the present invention, illustrating a shock absorbing action of the elastic terminal holder block.

As shown in FIG. 5, the bends 32 of the metal conducting terminals 30 are respectively kept in contact with the ribs 24 of the elastic terminal support rack 20 so that the ribs 24 give support to the respective metal conducting terminals 30 against downward sinking. As shown in FIG. 6, when a matting network plug (not shown) is inserted into the front insertion hole 11 of the insulation main body 10 (see also FIG. 2) to touch the bends 32 of the metal conducting terminals 30 and to force the bends 32 downwards (see the imaginary line), the return force of the elongated elastic block 23 and the ribs 24 enhances the contact force between the tilting portions 31 of the metal conducting terminals 30 and the respective metal conducting terminals of the inserted matting network plug.

Further, the elastic terminal support rack 20 comprises 8 isolation slots 25 downwardly extending from the front edge 21*b* of the rectangular open frame 21 in a parallel manner for the positioning of the front positioning end portions 34 of the metal conducting terminals 30 respectively, as shown in FIG. 5, to keep the metal conducting terminals 30 in a good order and to avoid a short circuit.

Figure 4:
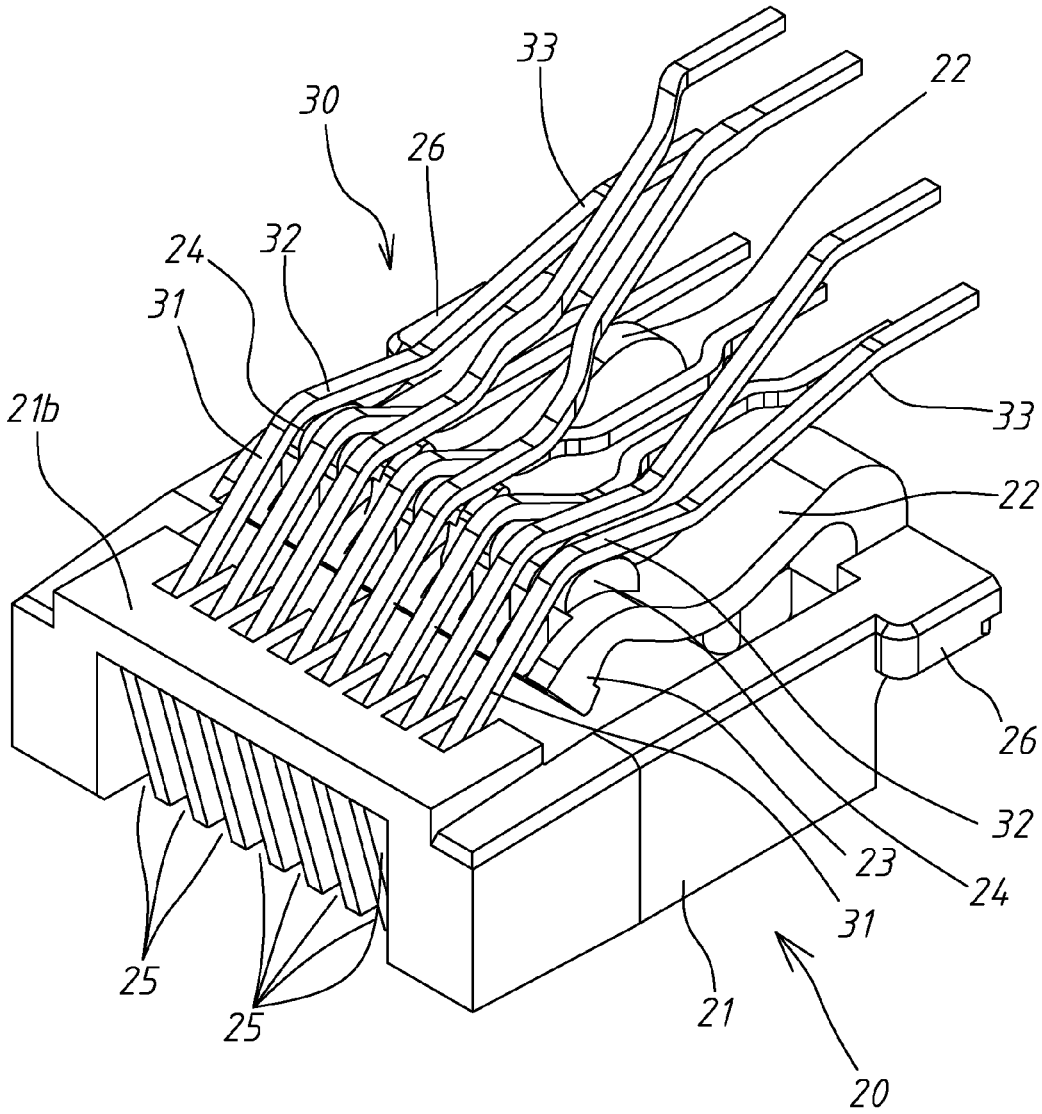
FIG. 4 is an elevational assembly view of FIG. 3.

Further, as shown in FIGS. 3 and 4, the elastic terminal support rack 20 comprises two protruding mounting blocks 26 respectively protruded from the two distal ends of the rear edge 21*a* of the rectangular open frame 21 for positioning in the insulation main body 10 to facilitate installation.

Although a particular embodiment of the invention has been described in detail for purposes of illustration, various modifications and enhancements may be made without departing from the spirit and scope of the invention. Accordingly, the invention is not to be limited except as by the appended claims.

What the invention claimed is:

1. A network connector, comprising:

an insulation main body defining a front insertion hole for the insertion of a matting network plug;

an elastic terminal support rack mounted in said insulation main body at a bottom side of said front insertion hole, said elastic terminal support rack comprising a rectangular open frame elastic terminal support rack having opposing front edge and rear edge, an elongated elastic block transversely suspending in said rectangular open frame, a plurality of arched bars connected between the rear edge of said rectangular open frame and said elongated elastic block and 8pcs of ribs located on a top side of said elongated elastic block and equally spaced in a parallel manner;

8pcs of metal conducting terminals mounted in said elastic terminal support rack, each said metal conducting terminal comprising a front positioning end portion positioned in said elastic terminal support rack, a rear tailpiece, a tilting portion connected between said front positioning end portion and said rear tailpiece for the contact of one corresponding metal conducting terminal of a matting network plug to be inserted into said front insertion hole of said insulation main body, and a bend connected between said tilting portion and said tailpiece and supported on one said rib of said elastic terminal support rack;

a circuit board perpendicularly attached to the rear edge of said elastic terminal support rack for the insertion and connection of said metal conducting terminals;

an insulation displacement contact housing disposed at a back side relative to said circuit board for the passing of a network cable to connect to said circuit board and said metal conducting terminals; and a back cover, said back cover comprising a top cover shell and a bottom cover shell respectively pivotally connected to a back side of said insulation main body and adapted for wrapping said insulation displacement contact housing.

2. The network connector as claimed in claim 1, wherein said 8pcs of ribs are respectively configured subject to the shape of the bends of said metal conducting terminals.

3. The network connector as claimed in claim 1, wherein said elastic terminal support rack further comprises 8 isolation slots downwardly extending from the front edge of said rectangular open frame in a parallel manner for the positioning of the front positioning end portions of said metal conducting terminals respectively.

4. The network connector as claimed in claim 1, wherein said elastic terminal support rack further comprises two protruding mounting blocks respectively protruded from two distal ends of the rear edge of said rectangular open frame for positioning in said insulation main body.

* * * * *